US005179044A

United States Patent [19]

Muromachi et al.

[11] Patent Number: 5,179,044

[45] Date of Patent: Jan. 12, 1993

[54] SECURING DEVICE FOR MALE PLUG/FEMALE SOCKET CONNECTORS

[76] Inventors: Paul N. Muromachi; Staci M. Muromachi, both of 46-270 Kahuhipa St., #A100, Kaneohe, Hi. 96744

[21] Appl. No.: 798,741

[22] Filed: Nov. 27, 1991

[51] Int. Cl.[5] ..... H01R 13/54

[52] U.S. Cl. ..... 439/369; 439/371; 439/368

[58] Field of Search ..... 439/369, 371, 367, 368, 439/345, 451, 471, 370, 502

[56] References Cited

U.S. PATENT DOCUMENTS

| | | | |
|---|---|---|---|
| 2,461,427 | 2/1949 | Kneebone | 439/369 |
| 2,725,543 | 11/1955 | Tanner | 439/371 X |
| 3,475,716 | 10/1969 | Laig | 439/369 |
| 3,781,761 | 12/1973 | Harwood | 439/371 X |
| 4,440,465 | 4/1984 | Elliott et al. | 439/369 |
| 4,514,026 | 4/1985 | Herbert | 439/369 X |
| 4,898,542 | 2/1990 | Jones, Jr. | 439/371 |
| 4,957,450 | 9/1990 | Pioszak | 439/369 |

*Primary Examiner*—Larry I. Schwartz
*Assistant Examiner*—Julie R. Daulton
*Attorney, Agent, or Firm*—Michael I. Kroll

[57] ABSTRACT

A securing device is provided for a male plug connector on a portable appliance cord and a female socket connector on an extension cord. The securing device comprises an elongated elastic member. A first mechanism is at a first end of the elongated elastic member, for attachment to the extension cord proximate the female socket connector. A second mechanism is at a center of the elongated elastic member, for attachment to the portable appliance cord proximate the male plug connector. A third mechanism is at a second end of the elongated elastic member, for attached to the extension cord proximate the female socket connector. The elongated elastic member can wrap around the female socket connector and the male plug connector, thereby securing the female socket connector to the male plug connector during the use of the portable appliance.

7 Claims, 2 Drawing Sheets

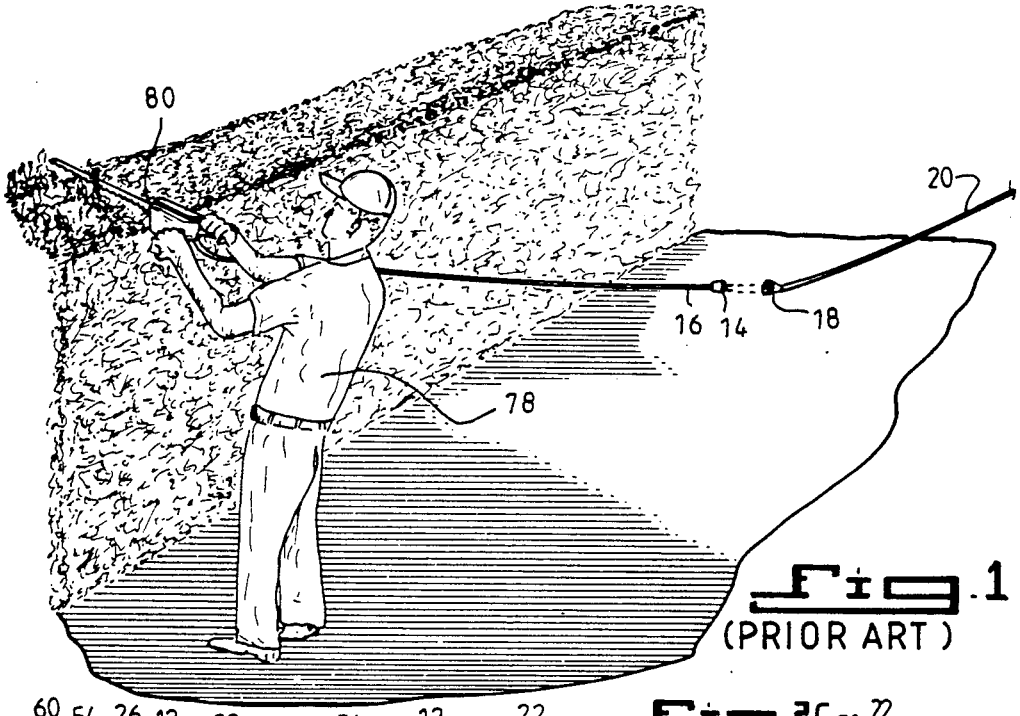
Fig. 1
(PRIOR ART)
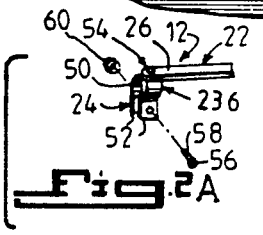
Fig. 2A
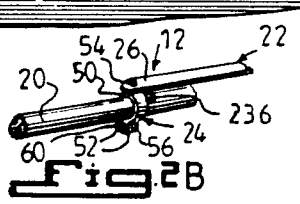
Fig. 2B
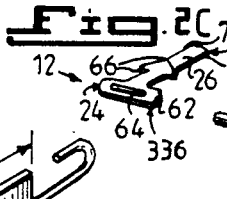
Fig. 2C
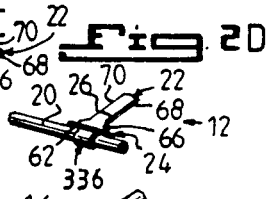
Fig. 2D
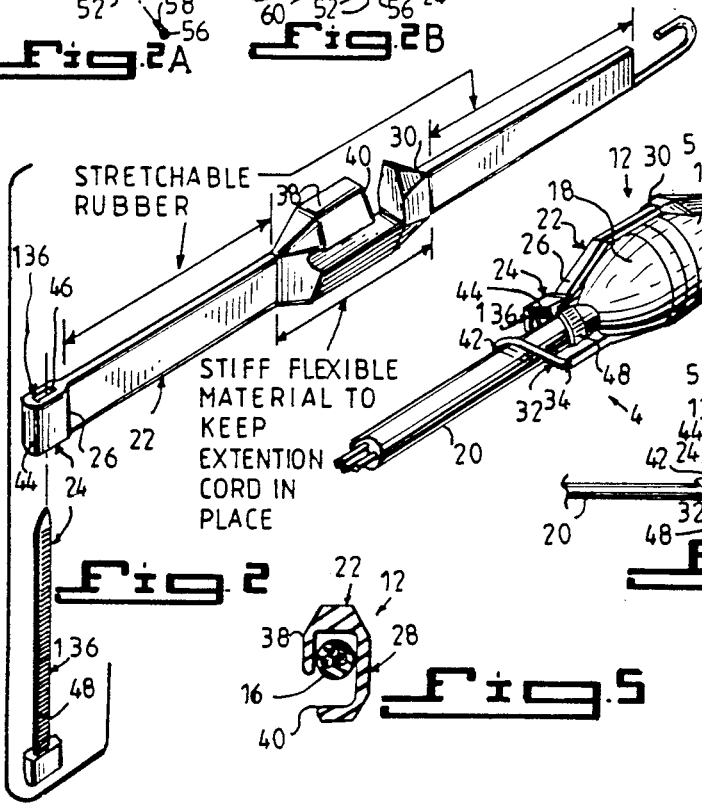
Fig. 2
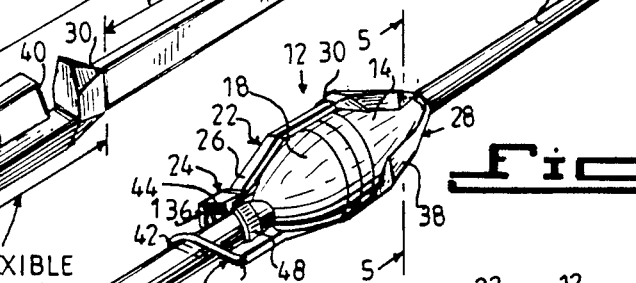
Fig. 3
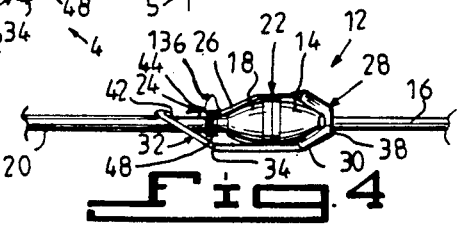
Fig. 4
Fig. 5

Fig. 6
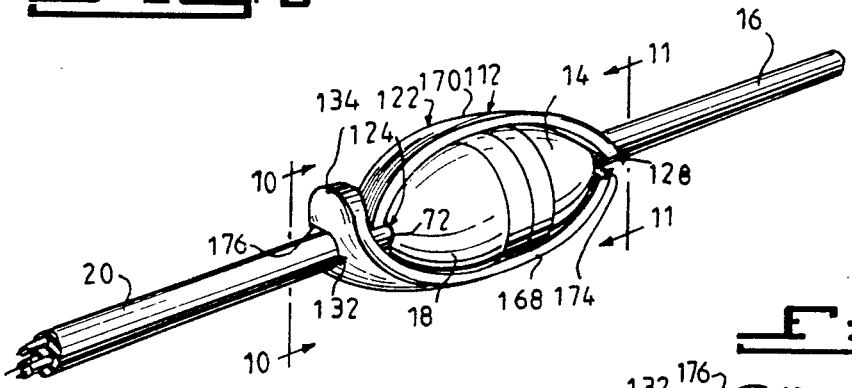
Fig. 7
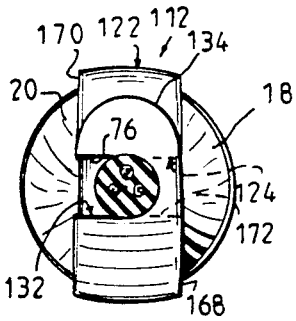
Fig. 10
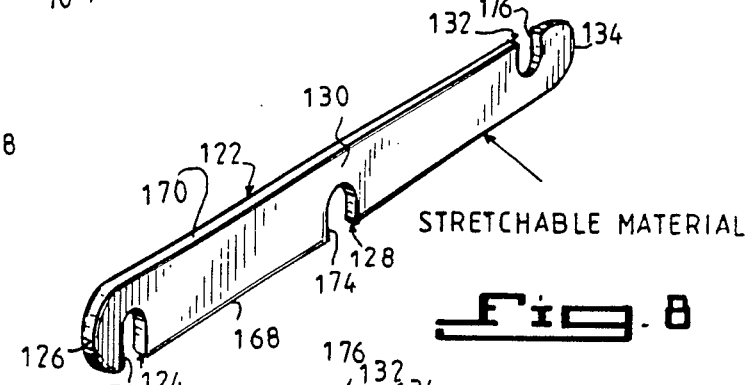
Fig. 8
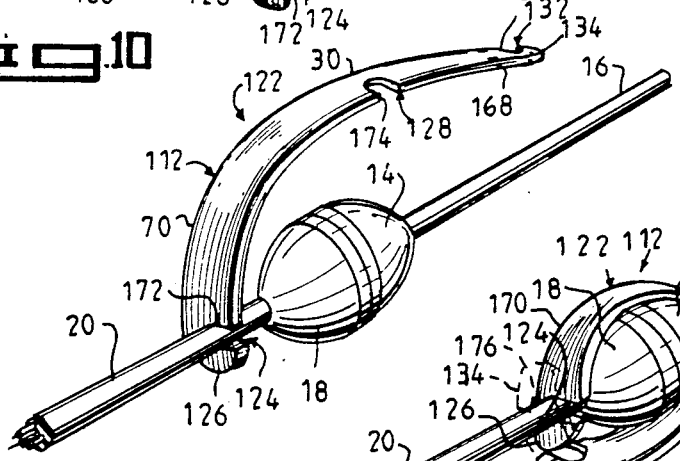
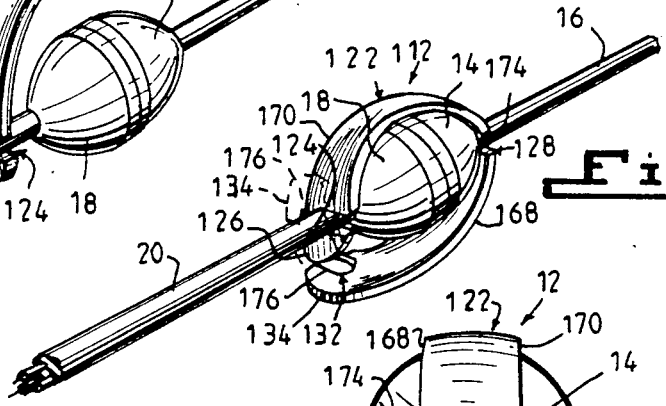
Fig. 9
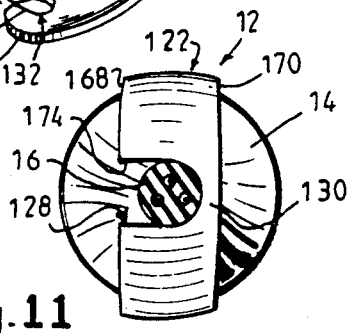
Fig. 11

SECURING DEVICE FOR MALE PLUG/FEMALE SOCKET CONNECTORS

BACKGROUND OF THE INVENTION

1. Field of the Invention

The instant invention relates generally to clamps and more specifically it relates to a securing device for male plug/female socket connectors.

2. Description of the Prior Art

Numerous clamps have been provided in prior art that are adapted to join, grip, support, compress mechanical and structural parts. While these units may be suitable for the particular purpose to which they address, they would not be as suitable for the purposes of the present invention as heretofore described.

SUMMARY OF THE INVENTION

A primary object of the present invention is to provide a securing device for male plug/female socket connectors that will overcome the shortcomings of the prior art devices.

Another object is to provide a securing device for male plug/female socket connectors for the purpose of keeping an extension cord from pulling apart when in use.

An additional object is to provide a securing device for male plug/female socket connectors that is used to bind the extension cord after use.

A further object is to provide a securing device for male plug/female socket connectors that is simple and easy to use.

A still further object is to provide a securing device for male plug/female socket connectors that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view showing a person using an extension cord without the instant invention.

FIG. 2 is a perspective view of a first embodiment of the instant invention per se.

FIG. 2A is a perspective view of a second extension cord gripping mechanism.

FIG. 2B is a perspective view of the second extension cord gripping mechanism in use.

FIG. 2C is a perspective view of a third extension cord gripping mechanism.

FIG. 2D is a perspective view of the third extension cord gripping mechanism in use.

FIG. 3 is a perspective view of the first embodiment of FIG. 2 in use.

FIG. 4 is a side view taken in direction of arrow 4 in FIG. 3.

FIG. 5 is a cross sectional view taken along line 5—5 in FIG. 3.

FIG. 6 is a perspective view of a second embodiment of the instant invention in use.

FIG. 7 is a perspective view of the second embodiment per se.

FIG. 8 is a perspective view of the second embodiment being attached at one end to the extension cord.

FIG. 9 is a perspective view similar to FIG. 8 showing the second embodiment being wrapped around the male plug and ready to be attached at the other end to the extension cord.

FIG. 10 is a cross sectional view taken along line 10—10 in FIG. 6.

FIG. 11 is a cross sectional view taken along line 11—11 in FIG. 6.

DETAILED DESCRIPTION OF THE PREFERRED EMBODIMENTS

Turning now descriptively to the drawings, in which similar reference characters denote similar elements throughout the several views, the figures illustrate a securing device 12 for a male plug connector 14 on a portable appliance cord 16 and a female socket connector 18 on an extension cord 20. The securing device 12 consists of an elongated elastic member 22. A first mechanism 24 is at a first end 26 of the elongated elastic member 22, for attachment to the extension cord 20 proximate the female socket connector 18. A second mechanism 28 is at a center 30 of the elongated elastic member 22, for attachment to the portable appliance cord 16 proximate the male plug connector 14. A third mechanism 32 is at a second end 34 of the elongated elastic member 22, for attachment to the extension cord 20 proximate the female socket connector 18. The elongated elastic member 22 can wrap around the female socket connector 18 and the male plug connector 14, thereby securing the female socket connector 18 to the male plug connector 14 during the use of the portable appliance.

The securing device 12 in FIGS. 2 through 5, show the first attachment mechanism 24 as a clamp (136, 236, 336) that is fixedly attached to the extension cord 20 proximate the female socket connector 18. The second attachment mechanism 28 is a stiff flexible segment 38 having an L-shaped notch 40 that is removably connected to the portable appliance cord 16 proximate the male plug connector 14. The third attachment mechanism 32 is a hook member 42 that is removably connected to the extension cord 20 proximate the female socket connector 18.

As shown in FIGS. 2, 3 and 4, the clamp 136 includes an enlarged head 44 on the first end 26 of the elongated elastic member 22. The enlarged head 44 has a transverse hole 46 therethrough. A wire tie 48 extends through the transverse hole 46 to wrap around the extension cord 20.

As shown in FIGS. 2A and 2B, the clamp 236 includes a U-shaped bracket 50 having a pair of legs 52. A pin 54 is for attaching the U-shaped bracket 50 to the first end 26 of the elongated elastic member 22. A bolt 56 has a shank 58 that extends through the legs 52 of the U-shaped bracket 50 when placed over the extension cord 20. A nut 60 threadably engages onto the shank 58 of the bolt 56 to retain the U-shaped bracket 50 to the extension cord 20.

As shown in FIGS. 2C and 2D, the clamp 336 includes a flat head 62 on the first end 26 of the elongated elastic member 22. The flat head 62 has a transverse slot 64 therethrough. A pair of triangular shaped protrusions 66 are also provided, with each extending oppositely from one side 68, 70 of the elongated elastic member 22, a short distance away from the flat head 62. The first end 26 of the elongated elastic member 22 can extend through the slot 66 in the flat head 62 and be wrapped around the extension cord 20 with the protrusions 66 preventing the removal of the first end 26 of the elongated elastic member 22 from the extension cord 20.

The elongated elastic member 22 is fabricated out of stretchable rubber material, while the stiff flexible segment 38 includes plastic embedded into the stretchable rubber material.

The securing device 112, has shown in FIGS. 6 through 11, is of another type, wherein the first attachment mechanism 124 is a first U-shaped notch 172 extending inwardly from a first side 168 of the elongated elastic member 122 proximate the first end 126 thereof and is sized to fit over the extension cord 20, proximate the female socket connector 18. The second attachment mechanism 128 is a second U-shaped notch 174 extending inwardly from the first side 168 of the elongated elastic member 122 at the center 130 thereof and is sized to fit over the portable appliance cord 16 proximate the male plug connector 14. The third attachment mechanism 132 is a third U-shaped notch 176 extending inwardly form a second opposite side 170 of the elongated elastic member 122 proximate the second end 134 thereof, and is sized to fit over the extension cord 20 proximate the female socket connector 18.

If the securing device (12, 112) is not utilized as shown in FIG. 1, then when a person 78 uses a portable appliance 80, such as an electric hedge trimmer, the male plug connector 14 on the portable appliance cord 16 will separate from the female socket connector 18 on the extension cord 20, thereby stopping the portable appliance 80 from operating.

To use the securing device (12, 112), the person 78 simply connects the first attachment mechanism 24 to the extension cord 20. When the female socket connector 18 is connected to the male plug connector 14, the second attachment mechanism 28 is connected to the portable appliance cord 16 proximate the male plug connector 14 and bent backwards, so that the third attachment mechanism 32 can also connected to the extension cord 20. This will prevent the accidental separation of the female socket connector 18 from the male plug connector 14, when the person 78 is using the portable appliance 80.

The securing device (12, 112) can also wrap around the extension cord 20 when the extension cord 20 is wound up and not being used. The extension cord 20 can now be conveniently stored so that it can be utilized at a later date.

LIST OF REFERENCE NUMBERS

12, 112: securing device
14: male plug connector
16: portable appliance cord
18: female socket connector
20: extension cord
22: elongated elastic member
24: first attachment mechanism
26: first end of 22
28: second attachment mechanism
30: center of 22
32: third attachment mechanism
34: second end of 22
136, 236, 336: clamp
38: stiff flexible segment
40: L-shaped notch in 38
42: hook member
44: enlarged head
46: transverse hole in 44
48: wire tie
50: U-shaped bracket
52: leg on 50
54: pin
56: bolt
58: shank on 56
60: nut
62: flat head
64: transverse slot in 62
66: triangular shaped protrusions
68: first side of 22
70: second side of 22
172: first U-shaped notch
174: second U-shaped notch
176: third U-shaped notch
78: person
80: portable appliance It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A securing device for a male plug connector on a portable appliance cord and a female socket connector on an extension cord, said securing device comprising:

a) an elongated elastic member;

b) first attachment means at a first end of said elongated elastic member is a clamp that is removably attachable to the extension cord proximate the female socket connection;

c) second attachment means at a center of said elongated elastic member, for attachment to the portable appliance cord proximate the male plug connector, said second attachment means is a stiff flexible segment having an L-shaped notch that is removably connected to the portable appliance cord proximate the male plug connector;

d) third attachment means at a second end of said elongated elastic member, for attachment to the extension cord proximate the female socket connector so that said elongated elastic member can wrap around the female socket connector and the male plug connector, thereby securing the female socket connector to the male plug connector during the sue of the portable appliance.

2. A securing device as recited in claim 1, wherein said third attachment means is a hook member that is removably connected to the extension cord proximate the female socket connector.

3. A securing device as recited in claim 2, wherein said clamp includes:

a) an enlarged head on the first end of said elongated elastic member, said enlarged head having a transverse hole therethrough; and b) a wire tie which extends through the transverse hole to wrap around the extension cord.

4. A securing device as recited in claim 2, wherein said clamp includes:

a) a U-shaped bracket having a pair of legs;

b) a pin for attaching said U-shaped bracket to the first end of said elongated plastic member;

c) a bolt having a shank to extend through the legs of said U-shaped bracket when placed over the extension cord; and d) a nut to threadably engage onto the shank of said bolt to retain said U-shaped bracket to the extension cord.

5. A securing device as recited in claim 2, wherein said clamp includes:

a) a flat head on the first end of said elongated elastic member, said flat head having a transverse slot therethrough; and b) a pair of triangular shaped protrusions, each extending oppositely from one side of said elongated elastic member a short distance away from said flat head, so that the first end of said elongated elastic member can extend through the slot in said flat head and be wrapped around the extension cord with said protrusions preventing the removal of the first end of said elongated elastic member from the extension cord.

6. A securing device as recited in claim 4, wherein said elongated elastic member is fabricated out of stretchable rubber material.

7. A securing device as recited in claim 6, wherein said stiff flexible segment includes plastic embedded into said stretchable rubber material.

* * * * *